United States Patent [19]

Place

[11] 4,397,637

[45] Aug. 9, 1983

[54] APPARATUS AND METHOD FOR CENTRIFUGING

[75] Inventor: Theodore W. Place, Woodland Hills, Calif.

[73] Assignee: The Garrett Corporation, Los Angeles, Calif.

[21] Appl. No.: 282,825

[22] Filed: Jul. 13, 1981

[51] Int. Cl.[3] ..... B04B 11/00

[52] U.S. Cl. ..... 494/1; 494/45

[58] Field of Search ..... 494/1, 2, 4, 45, 26, 494/27, 85; 55/160; 210/145, 147

[56] References Cited

U.S. PATENT DOCUMENTS

| | | | |
|---|---|---|---|
| 1,949,278 | 2/1934 | Johnson . | |
| 2,186,836 | 1/1940 | McGlaughlin . | |
| 2,324,933 | 7/1943 | Jones . | |
| 3,105,045 | 9/1963 | Borig . | |
| 3,145,173 | 8/1964 | Sharples . | |
| 3,179,334 | 4/1965 | Sharples . | |
| 3,244,362 | 4/1966 | Hein . | |
| 3,675,846 | 7/1972 | Drucker | 494/45 |

*Primary Examiner*—Robert W. Jenkins

*Attorney, Agent, or Firm*—Joseph A. Yanny; James W. McFarland; Albert J. Miller

[57] ABSTRACT

A centrifuge having automatic purging elements for discharging contaminants from the centrifuge in response to the rotational speed of the centrifuge.

39 Claims, 6 Drawing Figures

APPARATUS AND METHOD FOR CENTRIFUGING

BACKGROUND OF THE INVENTION

This invention relates to centrifuges and methods of centrifuging of the type used to separate mixtures of generally flowable components having differing specific gravities on a continuous process basis. More specifically, this invention relates to an improved centrifuge and method of centrifuging of the type which uses a rotating separation chamber to segregate the component elements of an oil-water-particulate contaminant mixture into isolated flow paths, which centrifuge and method includes use of an automatic purging element associated with the separation chamber and responsive to the rotational speed thereof to automatically purge the separation chamber of particulate contaminant buildup.

While the struggle to reduce dependence upon oil products continues, the stark reality is that the world's minimum daily requirement for these goods will not diminish during the many years required for the development of viable alternatives. Since the cost of crude oil is not easily controlled, the end user cost factors flowing from excessive labor and processing expense of conventional crude and reusable oil processes have been targeted for much needed technical cost saving solutions. This invention was borne at least in part, as a result of the attempts to aid the oil industry and the consumers of its products, in their search for one of these solutions, i.e. a more economical way to separate the oil water and particulate mixture that is obtained at the well head or from recycling sources into usable oil and disposable contaminants.

Crude oil obtained at the well head is typically placed in settling tanks for an extended period of time to allow particulate contaminants to filter out. It is then heated to separate the oil and water mixture. Oil-water mixtures which are to be recycled are also typically preprocessed in a similar manner.

As the cost of energy increases so too does the cost of heating crude or recyclable oil. As time becomes more expensive and the demand for usable oil more immediate, the time consuming settling process becomes more intolerable. Therefore, the less costly solution which has presented itself is the use of centrifuges to separate oil water mixtures. This is particularly true since even after conventional heating, the oil still contains fine particulate contaminants which must be isolated before further processing can continue.

In addition to addressing the energy needs of the oil consuming public, the present invention also tackles the complex environmental problems presented by ship bourne oil lubricated machinery by providing an economical tool for separating bilge oil-water-particulate mixtures into disposable water and particulate flows which may be safely dumped, and, oil flows which may be stored and possibly reused.

Centrifuges are well known in the prior art and typically comprise a separation chamber which is rotatable to cause isolation of the individual components of the mixture being centrifuged. However, for the most part these well known centrifuges are limited in application to batch process operations where the mixture is placed in a separate vessel and then placed in the separation chamber. Inherent in the use of these well known devices is the expense of excessive downtime and labor requirements. The economic infeasibility of such operations has condemned these units to laboratory settings.

Of the prior art centrifuges which are operable on a continuous process basis i.e. capable of handling a sustained flow of mixture, a first type failed to address the problem of automatically purging the system of heavy component contaminant buildup on the separation chamber inner surfaces by other than costly manual methods of repair and reconstruction. A second type provided structural elements which purged the system of particulate contaminants, but required cessation of fractioning operations during purging. These type devices, while more economically feasible in industrial settings nonetheless still required the frequent shutdown problems which this invention addresses.

SUMMARY OF THE INVENTION

This invention overcomes the problems of the prior art by providing a centrifuge which may be operated on a continuous basis and yet automatically purged of the particulate contaminant buildup without costly downtime. This is accomplished in the present invention by providing a flexible liner on the inner surface of the centrifuge separation chamber, sealing the ends of the flexible liner to the separation chamber to form an airtight space between the liner and the separation chamber, and charging the space with air or another suitable gas. The gas, upon sufficient rotation of the separation chamber, is compressed allowing the liner to lie nearly completely against the inner surface of the separation chamber. Particulate contaminants which would normally collect on the cylindrical inner surface of the centrifuge collect instead on the surface of the flattened liner. When the rotational speed of the separation chamber is sufficiently reduced or stopped, the reduced centrifugal force allows the air to expand and move the liner from its position near total contact with the inner surface of the separation chamber, towards the center of the separation chamber, thereby dislodging heavy particulate contaminant buildup in the chamber. The flowing stream of the heaviest, or outer component layer, or alternatively a special purging fluid, then washes away the particulate matter for disposal or reclamation.

While this invention is being described with reference to a centrifuge which is used for fractioning oil water mixture it should be understood that this in no way limits the invention to that type application. Indeed the present invention may well be applicable in any setting where a generally flowable mixture of components having differing specific gravities are desired to be separated. In this same vein it should be realized that it may well be, in certain settings, that it is the hevy particulates which are the desired end product. So while the remainder of this description will focus on the oil water type separators it should be understood that many modifications may be made to the system to adapt it to a variety of settings.

BRIEF DESCRIPTION OF THE DRAWINGS

The accompanying drawings illustrate the invention. In such drawings.

DETAILED DESCRIPTION OF THE PREFERRED EMBODIMENT

Figure 1:
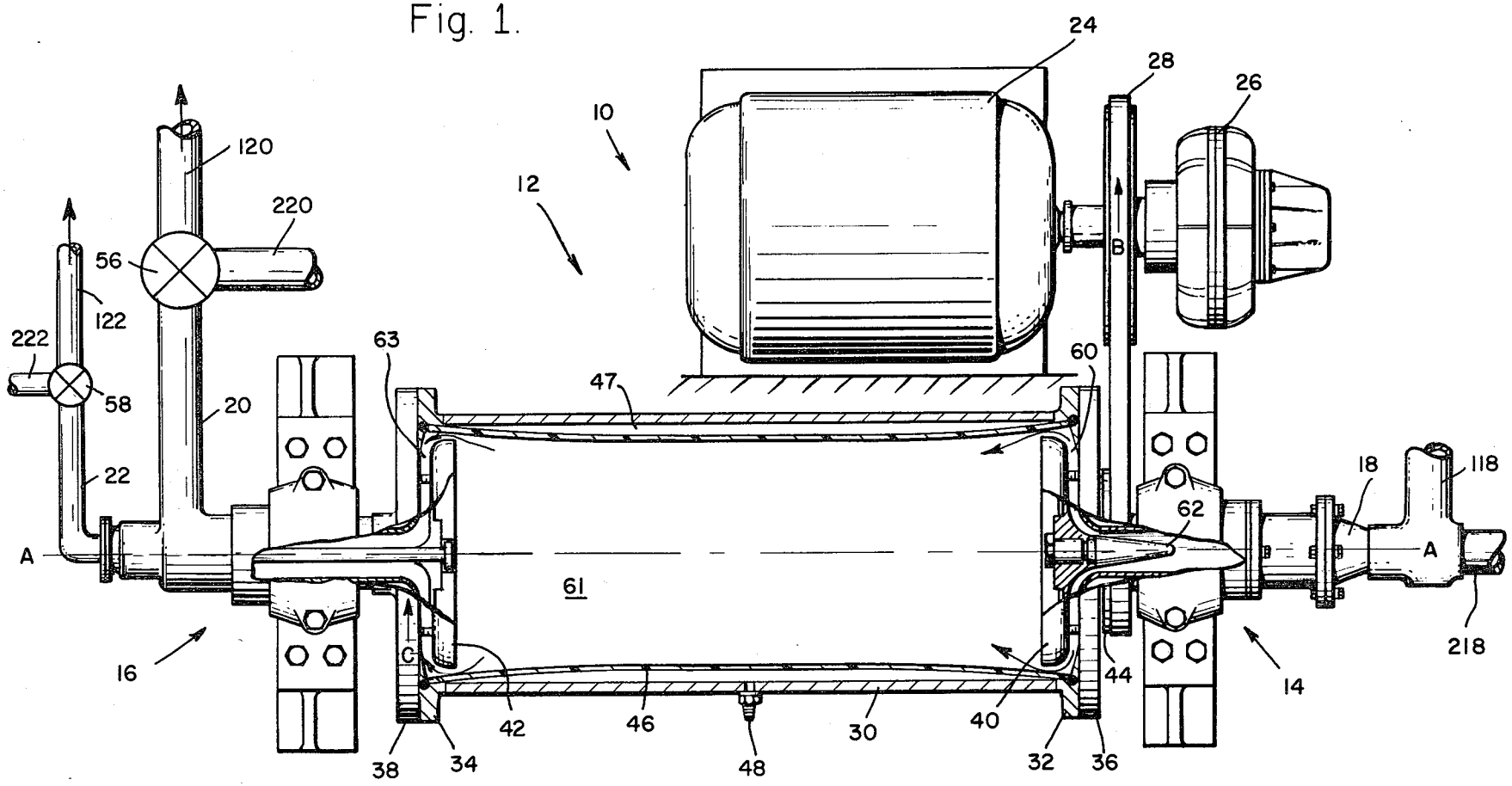
FIG. 1 is a partially fragmented sectional view of a centrifuge according to this invention.

Referring now to the drawings, a centrifuge 10 includes a rotatable separation chamber 12 which is supported for rotation about its axis AA by axially spaced load bearing yoke assemblies 14 and 16. An inlet pipe 18 supplies a sustained flow of a mixture of generally flowable component elements having differing specific gravities such as an oil water and particulate mixture to the separation chamber for separation. After separation the component elements of the mixture are funneled through segregated outflow paths 20 and 22. The interaction of motor 24 with hydraulic coupling 26 moves belt 28 in the direction indicated by arrow B which through interaction with separation chamber 12 causes rotation thereof in the direction indicated by arrow C.

Separation chamber 12 includes a stainless steel rotor drum 30 having cast inlet and outlet and flanges 32 and 34 at opposite axial ends for sealingly mating with inlet and outlet end bells 36 and 38 respectively. Also included in the separation chamber 12 is an inlet end diffuser plate 40, an outlet end plate 42, hub 44, and flexible polyurethane liner 46.

Flexible liner 46 is stretched over the inner surface of rotor drum 30 to form a fluid and air tight cavity 47 therebetween as shown best in FIG. 1. The cavity 47 is supplied with a charge of air or other suitable gas through a one-way check valve 48.

Figure 3:
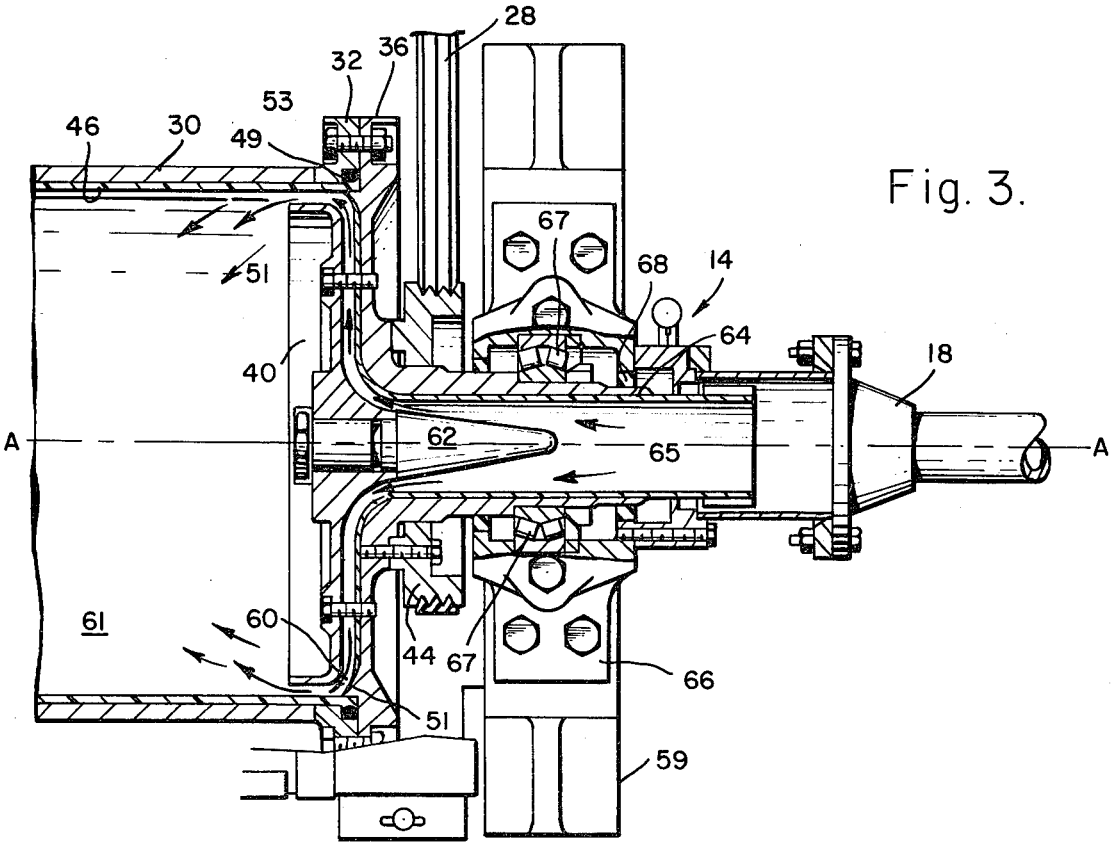
FIG. 3 is a fragmentary section view of the inlet end of the centrifuge of FIG. 1.
Figure 4:
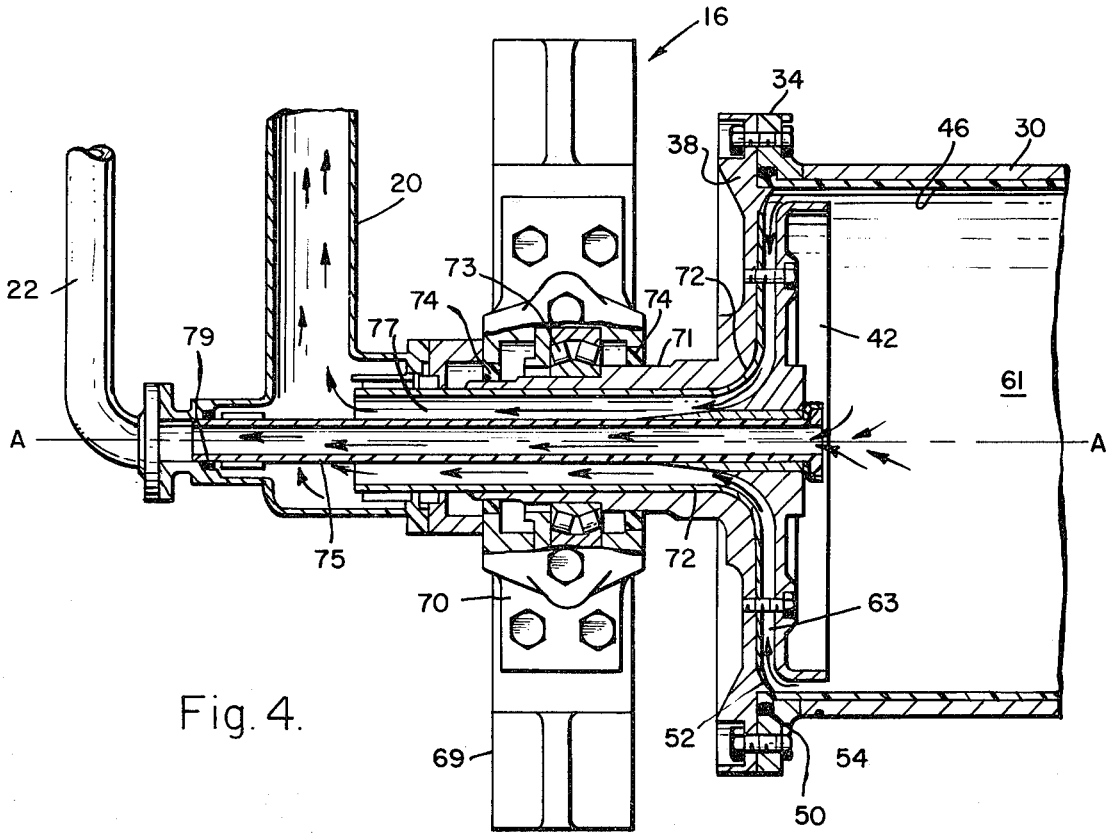
FIG. 4 is a fragmentary cross-sectional view of the outlet end of the centrifuge of FIG. 1.

Referring now to FIGS. 3 and 4, it is more easily seen that the flexible liner 46 is provided with integral sealing rings 49 and 50 at its opposite open ends which aid in maintaining the fluid tight nature of cavity 47 through interaction with lips 51 and 52 of inlet and outlet end bells 36 and 38 respectively. Thus, upon securement of the end bells 36 and 38 with opposite ends of the drum 30, the sealing rings 49 and 50 are retained in recesses 53 and 54 to prevent the charge air from escaping cavity 47.

Figure 2:
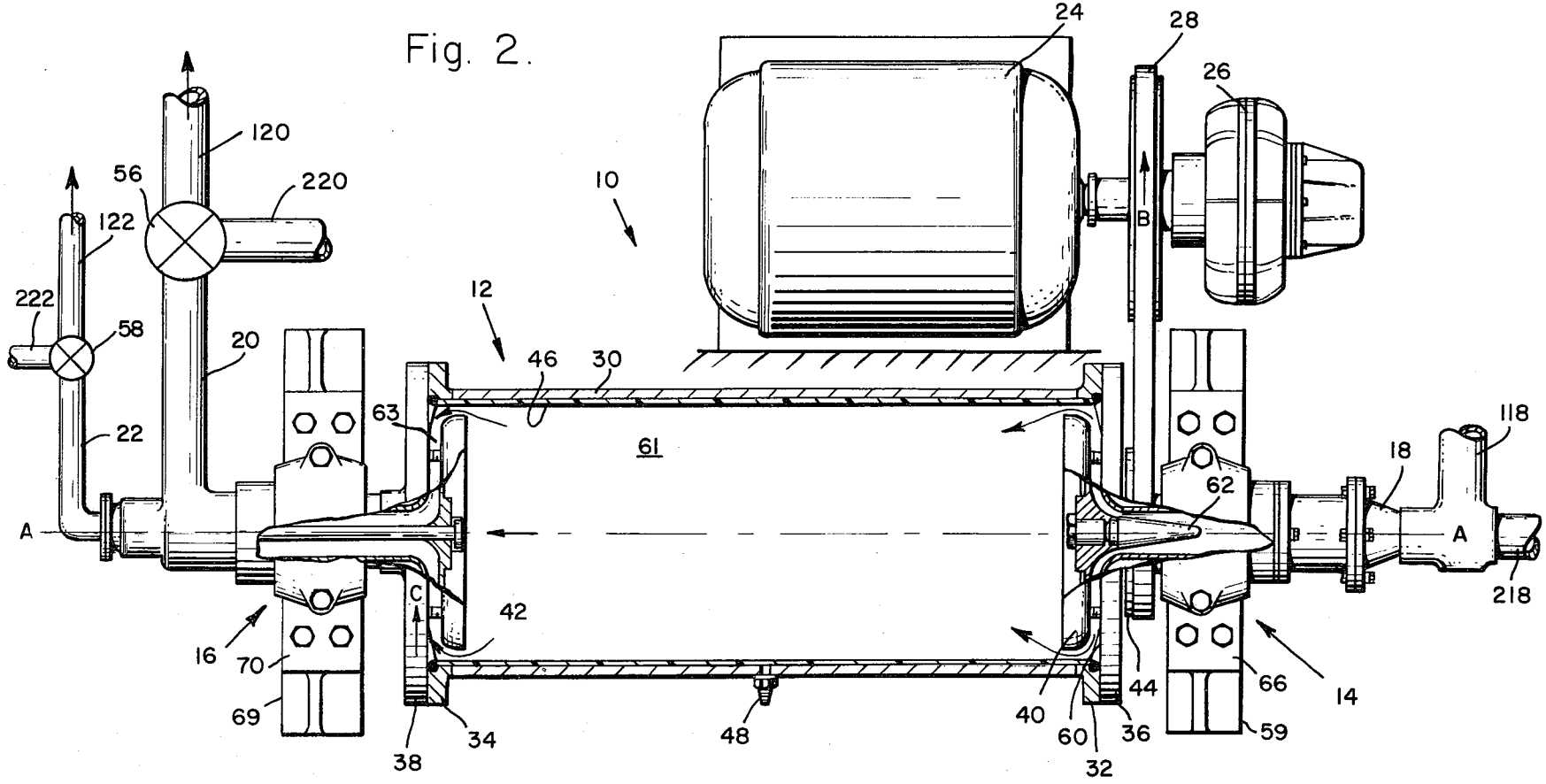
FIG. 2 is a partially fragmented sectional view of the centrifuge according to this invention showing the flexible liner in contact with the separation chamber.
Figure 6:
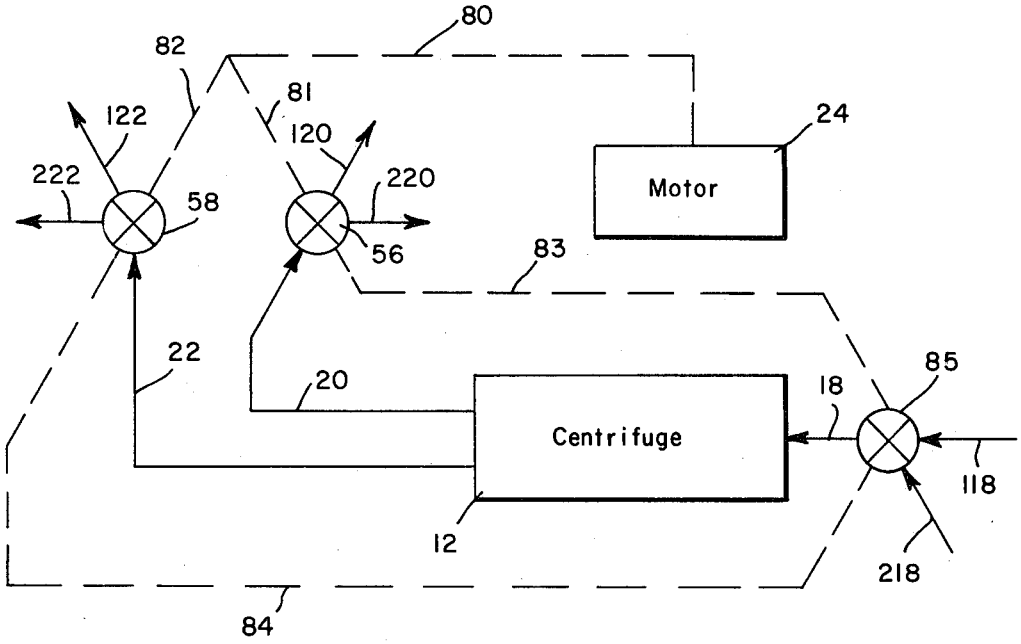
FIG. 6 is a schematic diagram illustrating the flow patterns of a centrifuge according to the present invention and some of the controls appurtinent thereto.

As shown in FIGS. 1, 2 and 6, inlet pipe 18 is connected to alternate sources of feed stock by pipes 118 and 218 respectively as will be more fully described herein below. In a similar vein outflow pipe 20 branches into alternate flow paths 120 and 220 downstream of valve 56. Similarly, outflow pipe 22 branches into alternate flow paths 122 and 222 downstream of valve 58. The purpose of the branching arrangements just described will be more fully described herein below.

The diffuser plate 40 and outlet plate 42 are attached to the inlet and outlet end bells 36 and 38 by bolts or other suitable means so as to be rotatable with the separation chamber 12. Plates 40 and 42 respectively define the beginning of inlet and outlet flow passages. More specifically, the inlet diffuser plate 40 is slightly smaller in radius than the inner radius of rotor drum 30 and when bolted to the inlet end bell 36 is spaced a sufficient distance therefrom to form flow passage 60 into the chamber through which feed stock (which may be the mixture or a special purging fluid) supplied through inlet pipe 18 may be properly guided into the inner-cavity 61 of the separation chamber 12. The inlet diffuser plate 40 is formed to include integral therewith or bolted thereto a projection 62 which cuts through the flowing feed stock as it is supplied to the separation chamber 12 to thereby reduce friction and allow the feed stock to enter the separation chamber 12 with a minimum load placed upon the pump (not shown in the drawings) which supplied the feed stock.

Output plate 42 is also smaller in radius than the inner-radius of rotor drum 30 and similarly bolted to outlet end bell 38 so as to be spaced therefrom a sufficient distance to form a flow path 63 for the denser of the component elements of the feed stock mixture as will be more fully described.

Referring now to FIG. 3, inlet end bell 36 is shown to include a sleeve portion 64 which projects away from the inner cavity 61 of the rotor drum 30 and which interacts with load bearing yoke assembly 14 to support the separation chamber 12 for rotation about axis AA. The inner surface of sleeve 64 includes a corrosion resistant liner 65 which protects the inlet end bell 36 from the corrosive effects of the feed stock as it travels from the inlet pipe 18 to the inner cavity 61 of rotor drum 30.

Inlet end yoke assembly 14 includes support structure 59 and cap 66 which are matable and retainable by bolts or other suitable means to form a tight seal which will allow sleeve 64 and thus separation chamber 12 to rotate about axis AA. Suitable bearings 67 are provided to allow for relatively friction free rotation of the separation chamber about axis AA and seals 68 are provided to maintain the integrity of the bearing 67 lubricating fluid which is encased in the chamber defined by the seals 68.

Referring now to FIG. 4, output end load bearing yoke assembly 16 is also shown to include support structure 69 and a cap 70 matable therewith to form a fluid tight seal about a sleeve 71 of outlet end bell 38. Outlet end bell 38 is also provided with a corrosive resistant liner 72 which rotates with the rotor drum 30 and which protects the end bell from the corrosive effects of the denser of the components after separation. A passage 77 inside the outlet end liner 72 is for carrying the denser of the component elements after separation and communicates with isolated outflow pipe 20 to form a portion of the segregated flow path for said component elements. The liner 72 in the area of sleeve 71 is generally symmetrically distributed about axis AA for rotation thereabout with separation chamber 12. Outlet end load bearing yoke assembly 16 is also provided with suitable bearing structures 73 which aid in providing relatively resistance free rotation of separation chamber 12 about axis AA. Seals are provided as at 74 to define a lubrication chamber for bearing 73 and thereby maintain the integrity thereof.

Outlet end plate 42 is provided with an inner sleeve 75 which is smaller in diameter than the sleeve 71 and liner 72 of outlet end bell 38. The sleeve 75 is formed integral with or suitably attached to outlet end plate 42 and arranged symmetrically about axis AA to rotate thereabouts in response to rotation of separation chamber 12. Sleeve 75 forms the first part of the segregated passageway for the less dense components of the mixture after separation and extends completely through sleeve 71 and liner 72 of end bell 38 to communicate with outflow path 22. Seal 79 is provided at the end of sleeve 75 to prevent interflow path leakage of the component elements from their segregated flow paths after fractioning has occurred.

Figure 5:
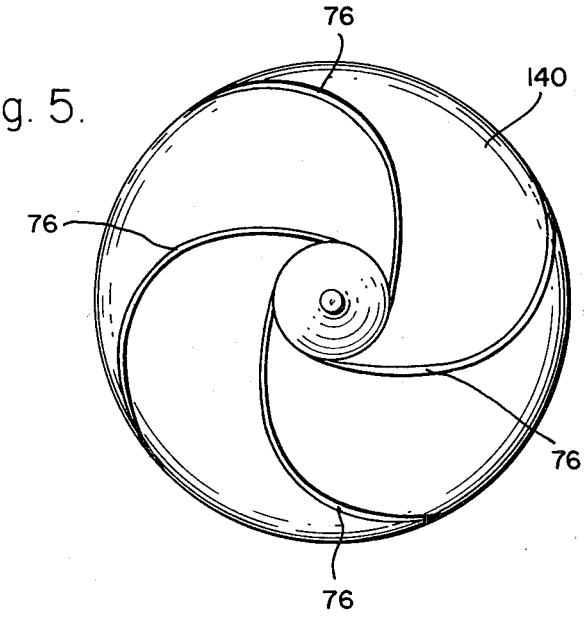
FIG. 5 is a plan view of an alternate inlet diffuser plate for use in the centrifuge of FIG. 1.

An alternate form of the inlet diffuser plate 40 is shown and designated as 140 in FIG. 5. The alternate diffuser plate includes raised ridges 76 on the side of the diffuser plate 140, which face inlet end bell 36 and which act as a turbine to reclaim some of the energy in the transported feed stock and thereby turn it into rotational energy of the separation chamber 12. The ridges 76 are also designed and curved so as to, when inserted in separation chamber 12, direct the incoming feed stock so as to have a component of velocity opposed to the rotational direction of rotor drum 30 to wash heavy particulate contaminent buildup on liner 46 away from the inlet area and further downstream in separation chamber 12.

Referring now to FIG. 6, a schematic diagram illustrating the flow patterns of the centrifuge of the present invention with some of the controls appurtinent thereto is shown and illustrated. Specifically, valves 56 and 58 are shown as controllable via actuators (not shown in the drawings) and lines 80, 81 and 82 respectively, to control the flow of material from segregated outflow pipes 20 and 22 respectively through, on the one hand, either line 120 or 220, and on the other hand, line 122 or 222 in response to rotational speed of motor 24. Similarly, valves 56 and 58 are shown as controllable, to the same end result, through actuators (not shown) and lines 83 and 84 in response to whether valve 85 is feeding stock supply from line 118 or line 218 to inlet pipe 18. Lines 80 thru 84 are intended to be of any conventional hydraulic or electrical composition and suitable for sensing conditions and transmitting those conditions to act as control parameters at their destination.

In operation, the feed stock is fed through line 218, which feed stock consists of an oil water particulate mixture, and is channeled through inlet pipe 18 through sleeve and liner structure 64 and 65 and towards the separation chamber 12. The mixture is diverted by interaction with diffuser plate outwardly and away from axis AA until interaction with rotor drum 30 and liner 46 causes the fluid to be redirected into the inner cavity 61 of the separation chamber 12. The turbulent action of the fluid as it ends its excursion away from axis AA and is redirected (which is coupled with the effects of ridges 76 if the alternative diffuser plate 140 of FIG. 6 is used) causes any heavy particulate buildup near the inlet end bell 36 to be washed further downstream into the rotor drum 30 thereby preventing clogging of the centrifuging of the present invention. As the fluid oil-water mixture enters the separation drum 30 the rotation of the separation chamber 12 in response to rotation of the electric motor 24 causes a centrifuging action, and force is applied to the mixture thereby causing the denser of the elements to be thrown outward and away from axis AA and towards the inner surfaces of rotor drum 30.

The force of the denser component elements acting upon flexible liner 46 tends to compress the gas or other suitable fluid in air tight cavity 47 thereby flattening the liner generally near the inner surface of the rotor drum 30 as shown in FIG. 2. The denser of the elements (usually the particulates) collect upon the liner 46. Under optimum conditions, the components of the mixture completely separate into isolated layers within the separation chamber 12.

With an oil water particulate mixture the particulates typically collect on the flexible liner 46 with the water forming an abutting flowing layer. The inner least dense component layer is the oil which occupies the space generally near axis AA thereby being aligned with the inlet of outlet plate sleeve 75.

The water is drawn through flow path 63 for ultimate transport through sleeve and liner structure 71 to segregated outflow pipe 20. Similarly, the oil flows through outlet plate sleeve 75 for ultimate transport to segregated outflow pipe 22 as previously described.

When the rotational speed of separation chamber 12 is sufficiently reduced the force of the component elements of the mixture on liner 46 and the gas in cavity 47 becomes substantially lessened so as to allow the air in cavity 47 to expand thereby forcing portions of flexible liner 46 towards axis AA to dislodge dense particulate buildup thereon. The flowing water layer washes the particulates through flow path 63. Since, however, the lessened rotational speed of the separation chamber 12 can cause incomplete separation of the mixture, valves 56 and 58, in response to signals from lines 80–82 (FIG. 6), may be used to divert flow of the partially separated components through recycle or waste pipes 220 and 222 instead of through pure component lines 120 and 122. Alternatively, a special purging fluid can be fed through pipe 118 and used to clean the separation chamber at reduced rotational speeds with the control of valves 56 and 58 being accomplished through lines 83 and 84 respectively in response to the condition of valve 85 (FIG. 6) which detects the source of feed fluid into inlet pipe 18.

From the preceding, it should be readily apparent that the present invention also contemplates a method of separating flowing mixtures of components having differing specific gravities such as oil-water and particulate mixtures into generally flowing and segregated component layers on a continuous process basis. A flow of the mixture is supplied to a sufficiently rotating separation chamber and separated into the layers. The layers are individually funneled off into the segregated outflow paths and the separation chamber is periodically and automatically purged of contaminant buildup in response to the rotational speed of the separation chamber. The mixture is funneled radially outwardly as it enters the separation chamber to prevent it from passing through without separating. The step of automatically purging the system of contaminant buildup includes: providing a flexible liner of the inner surface of the separation chamber to provide a fluid tight air holding cavity and supplying a charge of compressible fluid therein; rotating the chamber to compress the fluid and separate the mixture; and then reducing the rotational speed sufficiently to allow the flexible liner to expand and dislodge the contaminant buildup thereon.

Clearly, it is within the spirit of the invention to provide means for providing a greater radially inward force upon liner 46 by increasing gas pressure in cavity 47 to accomplish the results desired.

While the particular embodiment has been described in detail, it should be understood that modifications may be made to the system without departing from the scope and spirit of the invention as set forth in the appended claims.

What is claimed and desired to be secured by U.S. Letters Patent is:

1. A centrifuge of the type used to separate a generally flowable mixture of components having differing specific gravities on a continuous process, comprising:

separation chamber means rotatable generally about its axis for separating said mixture into generally flowing component layers;

means for rotating said separation chamber means about said axis to separate said mixture;

inlet means for communicating said separation chamber means with said mixture;

outlet means for individually communicating said components with generally segregated outflow paths; and means operably associated with said separation chamber means and responsive to the rotational speed thereof for automatically purging said separation chamber means of component contaminant buildup.

2. The centrifuge of claim 1 wherein said means for automatically purging includes:

flexible liner means for forming a generally fluid tight cavity adjacent to said separation chamber means to receive a pressurized and generally compressible fluid wherein said fluid permits the liner to expand with decreasing rotational speed of the separation chamber to thereby dislodge and automatically purge the chamber of contaminant buildup.

3. The centrifuge of claim 2 wherein said separation chamber means includes recess means for sealingly engaging said flexible liner and said flexible liner includes sealing bead means for insertion in said recess means to form said cavity.

4. The centrifuge of claim 1 wherein said separation chamber means includes:

drum means rotatable about said axis for separating said mixture; and end bell means for sealingly mating with said drum means.

5. The centrifuge of claim 4 wherein said means for automatically purging includes:

flexible liner means for forming a generally fluid tight cavity adjacent said drum means to receive a pressurized and generally compressible fluid wherein said fluid permits the liner means to expand with decreasing rotational speed of the separation chamber to thereby dislodge and automatically purge the drum of contaminant buildup.

6. The centrifuge of claim 5 wherein said drum means includes recess means for cooperative interaction with said end bell means to sealingly retain said flexible liner generally near said drum means to form said fluid tight cavity.

7. The centrifuge of claim 6 wherein said flexible linear means includes sealing ring means for insertion in said recess means; and said end bell means includes lip means for cooperative interaction with said recess means to retain said sealing ring means therein when said end bell and drum means are sealingly mated.

8. The centrifuge of claim 1 wherein said separation chamber means includes:

an axially open ended drum means rotatable about said axis for separating said mixture; and end bell means for sealingly mating with said drum means near said axially open ends to form a flight tight seal.

9. The centrifuge of claim 8 wherein said means for automatically purging includes:

flexible liner means for forming a generally fluid tight cavity between said drum means and said liner means to receive a pressurized and generally compressible fluid wherein said fluid permits the liner means to increasingly expand with decreasing rotational speed of the separation chamber to thereby dislodge and automatically purge the drum of contaminant buildup on said liner means.

10. The centrifuge of claim 9 wherein said liner means includes sealing ring means generally near its ends;

said drum means includes recess means generally near said axially open ends for receiving said sealing ring means; and said end bell means include lip means for cooperatively interacting with said recess means to retain said sealing ring means in said recess means and thereby form said fluid tight cavity when said drum and end bell means are sealingly mated.

11. The centrifuge of claims 5, 6, 7, 9, or 10 wherein said drum means includes check valve means for supplying said cavity with a charge of said compressible fluid.

12. The centrifuge of claims 4, 5, 6, 7, 8, 9 or 10 including load bearing yoke assembly means wherein said end bell means include:

means for interacting with said load bearing yoke assembly means for supporting said separation chamber means for said rotation.

13. The centrifuge of claim 12 wherein said end bell means includes inlet end bell means generally near said inlet means having sleeve means for interacting with said load bearing yoke assembly means and communicating said separation chamber means with said flow of mixture.

14. The centrifuge of claim 13 wherein said inlet means includes diffuser plate means operatively coupled to said inlet end bell means for diverting said mixture outwardly away from said axis to prevent said mixture from passing through said outlet means before separation.

15. The centrifuge of claim 14 wherein said diffuser plate means includes ridge means for directing the mixture to reduce contaminant buildup near said inlet.

16. The centrifuge of claim 12 wherein said end bell means includes outlet end bell means generally near said outlet means having sleeve means for interacting with said load bearing yoke assembly means and communicating said separation chamber with at least one of said segregated outflow paths.

17. The centrifuge of claim 16 wherein said outlet end bell sleeve means communicates the denser of said components with a first segregated outflow path.

18. The centrifuge of claim 17 wherein said outlet end bell means includes plate means operably associated therewith having sleeve means for communicating a lesser dense one of said components with a second of said segregated outflow paths.

19. A centrifuge of the type used to separate a generally flowable mixture of components having differing specific gravities, at least one of said components being a heavy particulate contaminant entrained in said mixture, on a continuous process basis, comprising:

separation chamber means rotatable about its longitudinal axis for separating said mixture into generally discrete flowing component layers;

means for rotating said separation chamber means about said longitudinal axis to separate said mixture;

inlet means for communicating said separation chamber means with a sustained flow of said mixture;

outlet means for individually communicating said component layers with generally segregated outflow paths; and means operably associated with said chamber means and responsive to the rotational speed thereof for automatically purging said separation chamber means of dense particulate contaminant buildup in said separation chamber.

20. The centrifuge of claim 19 wherein said means for automatically purging includes:

flexible liner means for forming a generally fluid tight cavity adjacent to said separation chamber means to receive a pressurized and generally compressible fluid wherein said fluid permits the liner to expand with decreasing rotational speed of the separation chamber to thereby dislodge and automatically purge the chamber of particulate buildup thereon.

21. The centrifuge of claim 20 wherein said separation chamber means includes recess means for sealingly engaging said flexible liner and said flexible liner includes sealing ring means for insertion in said recess means to form said cavity.

22. A centrifuge of claim 19 wherein said separation chamber means include cylindrical hollow drum means rotatable about said longitudinal axis for separating said mixture; and end bell means for sealingly mating with said cylindrical drum means.

23. The centrifuge of claim 22 wherein said means for automatically purging includes:

flexible liner means for forming a generally fluid tight cavity adjacent said cylindrical drum means to receive a pressurized and generally compressible fluid therein, wherein said fluid permits the liner means to expand with decreasing rotational speed of the separation chamber to thereby dislodge and automatically purge the cylindrical drum means for particulate contaminant buildup thereon.

24. The centrifuge of claim 23 wherein said cylindrical drum means includes recess means for cooperative interaction with said end bell means to sealingly retain said flexible liner generally near said cylindrical drum means to form said fluid tight cavity.

25. The centrifuge of claim 24 wherein said flexible liner means include sealing ring means for insertion in said recess means; and said end bell means includes lip means for cooperative interaction with said recess means to retain said sealing ring means therein when said end bell and cylindrical drum means are sealingly mated.

26. A centrifuge of the type used to separate a generally flowable mixture of oil water and particulate contaminants having differing specific gravities, said particulate contaminants being of a denser nature than said oil or water, on a continuous process basis, comprising:

an axially open-ended drum means rotatable about its longitudinal axis for separating said mixture into generally discrete flowing component layers;

means for rotating said axially open-ended drum means about said longitudinal axis to separate said mixture into its component elements;

inlet and outlet end bell means for sealingly mating with said axially opened drum means near said axially open ends to form a fluid tight seal;

inlet means for communicating said separation chamber means with a sustained flow of said mixture;

outlet means for individually communicating said separated and generally flowable oil and water layers with segregated outflow paths; and flexible liner means for forming a generally fluid tight cavity between said drum and said flexible liner means to receive a pressurized and generally compressible fluid therein wherein said fluid permits the flexible liner means to increasingly expand with decreasing rotational speed of the axially open-ended drum means to thereby dislodge dense particulate contaminant buildup on said flexible liner means and into said flowing water layer for wash away and purging of the drum means.

27. The centrifuge of claim 26 wherein:

said flexible liner means includes sealing ring means generally near its ends;

said axially opened drum means includes recess means generally near said axially opened ends for receiving said sealing bead means therein; and said end bell means include lip means for cooperatively interacting with said recess means to retain said sealing bead means in said recess means and thereby form said fluid tight cavity when said cylindrical open-ended drum and end bell means are sealingly mated.

28. The centrifuge of claim 27 wherein said axially open-ended drum means includes check valve means for supplying said cavity with a charge of said compressible fluid.

29. The centrifuge of claim 27 including inlet and outlet end load bearing yoke assembly means, wherein said inlet and outlet end bell means include sleeve means for interacting with said load bearing yoke assembly means for supporting said axially open-ended drum means for said rotation about said longitudinal axis.

30. The centrifuge of claims 26 or 29 including diffuser plate means operably coupled to said inlet end bell means for diverting said mixture outwardly away from said longitudinal axis to prevent said mixture from passing through said outlet means before separation.

31. The centrifuge of claim 30 wherein said diffuser plate means include ridge means for acting as a turbine to capture energy from said flowing mixture as it enters said cylindrical drum means, and for directing said mixture in a direction having a vector component opposed to the direction of rotation of said cylindrical drum means to thereby wash particulate buildup away from the inlet end bell to prevent clogging of the entry to the cylindrical drum means.

32. The centrifuge of claim 26 or 29, said outlet means including outlet plate means operably coupled to said outlet end bell means for diverting said oil and water layers after separation into said segregated outflow paths.

33. The centrifuge of claim 32 wherein said outlet plate means is smaller in diameter than the inner diameter of said open ended drum means, said outlet end bell means and said outlet plate means are spaced a sufficient distance relative to each other to form the beginning of the segregated outflow path for said water in the separation; and said outlet plate means includes inner sleeve means generally near said longitudinal axis for forming the beginning of the segregated outflow path for said oil after separation.

34. A method for separating flowing mixtures of components having differing specific gravities into generally flowing and segregated components on a continuous process basis comprising the steps of:

providing a flow of said mixture to a rotatable separation chamber to form a flowing mass therethrough;

rotating said separation chamber about its axis to separate said flowing mass into discrete generally flowing layers of said components; and funneling said components out of said separation chamber and into segregated outflow paths; and automatically purging said separation chamber of component contaminant buildup in response to the rotational speed of said separation chamber.

35. The method of claim 34 including the step of diffusing the mixture radially outwardly from a point generally near its point of entry into said separation chamber to prevent the mixture from being funneled out of said separation chamber before separation into said components.

36. The method of claim 35 including the step of directing said mixture in a direction having a component opposed to the direction of said separate chambers to prevent contaminant buildup near said point of entry.

37. The method of claim 34 wherein said separation chamber includes flexible liner means operably associated therewith to form a fluid tight cavity; and said step of automatically purging includes the steps of:

providing a charge of compressible fluid in said cavity;

sufficiently rotating said separation chamber to compress said fluid, reduce the volume of said cavity and separate said mixture into said component layers; and reducing the rotational speed of said separation chamber to allow said fluid cavity and flexible liner to expand thereby dislodging said contaminants for wash away.

38. A method for mechanically separating flowing oil water and particulate mixtures having differing specific gravities into generally flowing and segregated components on a continuous process basis comprising the steps of providing a flow of said mixture to a rotatable separation chamber to form a flowing mass therethrough;

rotating said separation chamber about its axis to separate said flowing mass into discrete generally flowing layers of said components;

and funneling said components out of said separation chamber and into segregated outflow paths; and automatically purging said separation chamber of particulate component contaminant buildup in response to the rotational speed of said separation chamber by providing flexible liner means operably associated with said separation chamber to form a fluid tight cavity; providing a charge of compressible fluid in said cavity; and sufficiently rotating said separation chamber to compress said fluid, reduce the volume of said cavity and separate said mixture into said component layers and reducing the rotational speed of said separation chamber to allow said fluid cavity and flexible liner to expand thereby dislodging said contaminants for wash away by the outer or water layer.

39. A centrifuge of the type used to separate a generally flowable mixture of oil water and particulate contaminants having different specific gravities, said particulate contaminants being of a denser nature than said oil or water, on a continuous process basis, comprising:

an axially open ended drum means rotatable about its longitudinal axis for separating said mixture into generally discrete flowing component layers therewithin, said drum means having recess means near its axially open ends and adjacent the inner surface thereof;

electric motor and belt means operatively associated with said drum means for rotating said axially open ended drum means about said longitudinal axis to separate said mixture into its component elements;

inlet and outlet end bell means for sealingly mating with said axially open ended drum means near said axially open ends to form a fluid tight seal, said end bell means including ridge means for interacting with said recess means when said inlet and outlet end bell means are mated with said drum means;

inlet means for communicating said separation chamber means with a sustained flow of said mixture including inlet end bell sleeve means having a corrosive resistant liner;

outlet means for individually communicating said separated and generally flowable oil and water layers with segregated outflow paths including outer end bell sleeve means having a corrosive resistant liner for communicating said water layer with a first segregated outflow path and an outlet end plate having a smaller diameter than the inner diameter of the drum means and operably associated with the outlet end bell means and spaced a sufficient distance with respect thereto to form the beginning of said first or water flow path, said outlet end plate including integral inner sleeve means concentrically distributed about said longitudinal axis and extending through said outer sleeve means for aligning with the generally flowable oil layer;

flexible liner means for forming a generally fluid tight cavity between said drum and said flexible liner means to receive a pressurized and generally compressible fluid therein wherein said fluid permits the flexible liner means to increasingly expand with decreasing rotational speed of the axially open ended drum means to thereby dislodge dense particulate contaminant buildup on said flexible liner means and into said flowing water layer for wash away and purging of the drum means, said flexible liner means including sealing ring means generally near its ends for insertion in said recess means of said axially open ended drum means for retention therein by said lip means of said end bell means when said cylindrical open ended drum means and end bell means are sealingly mated;

inlet and outlet load bearing yoke assembly means for interaction with said inlet and outlet end bell sleeve means to support said axially open ended drum means for said rotation; and diffuser plate means having a smaller diameter than the inner diameter of said axially open ended drum and operably associated with said inlet end bell means for rotation therewith about said axis for preventing said mixture from entering said outlet means before separation of the mixture into its component elements, said inlet diffuser plate means including ridge means for directing said mixture into said drum means in a direction having a vector component opposed to the direction of rotation of said drum means to prevent dense particulate buildup near said inlet and thereby prevent centrifuge clogging, and for acting as a turbine to capture some of the energy in said flowing mixture and to convert said energy into rotational energy of the axially open ended drum.

* * * * *